US006725937B1

(12) United States Patent
McHardy

(10) Patent No.: US 6,725,937 B1
(45) Date of Patent: Apr. 27, 2004

(54) DOWNHOLE APPARATUS

(75) Inventor: Colin McHardy, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/936,259

(22) PCT Filed: Mar. 8, 2000

(86) PCT No.: PCT/GB00/00830

§ 371 (c)(1),
(2), (4) Date: Apr. 22, 2002

(87) PCT Pub. No.: WO00/53885

PCT Pub. Date: Sep. 14, 2000

(30) Foreign Application Priority Data

Mar. 8, 1999 (GB) ..... 9905279

(51) Int. Cl.[7] ..... E21B 34/06
(52) U.S. Cl. ..... 166/373; 166/386; 166/334.4
(58) Field of Search ..... 166/373, 386, 166/334.1, 334.4, 321, 323

(56) References Cited

U.S. PATENT DOCUMENTS 3,780,809 A 12/1973 Ayers, Jr. et al. ..... 166/314
3,871,193 A 3/1975 Young ..... 64/23
4,413,516 A 11/1983 Croom, Jr. et al. ..... 73/431
4,619,320 A 10/1986 Adnyana et al. ..... 166/65.1
4,716,963 A * 1/1988 George et al. ..... 166/123

FOREIGN PATENT DOCUMENTS

EP 0 301 734 2/1989 ..... E21B/34/10
GB 2 118 998 11/1983 ..... E21B/34/08
GB 2 309 470 7/1997 ..... E21B/21/10

* cited by examiner

*Primary Examiner*—William Neuder
(74) *Attorney, Agent, or Firm*—Moser, Patterson & Sheridan, L.L.P.

(57) ABSTRACT

Downhole apparatus comprises a body for mounting on a tubular string, the body defining an internal bore. A fluid pressure actuated valve member is movable relative to the body and a normally closed flow port is provided in the valve member. With the valve member in a first position relative to the body the port is closed, and with the valve member in a second position the port is open to permit fluid communication therethrough between the body bore and the exterior of the body. The valve member is biassed towards the first position. A fluid pressure actuated latch arrangement releasably retains the valve member in the first position, the latch arrangement being releasable on application of a predetermined cracking pressure to allow the unlatched valve member to move to the second position in response to a valve opening pressure lower than the cracking pressure. The latch is resettable to relatch the valve member on return of the valve member to the first position.

34 Claims, 3 Drawing Sheets

DOWNHOLE APPARATUS

CROSS-REFERENCE TO RELATED APPLICATIONS

This application claims benefit of International Application No. PCT/GB 00/00830, filed Mar. 8, 2000 and published under PCT Article 21 (2) in English, and claims priority of United Kingdom Application No. 9905279.7, filed on Mar. 8, 1999. Each of the aforementioned related patent application is herein in by reference.

BACKGROUND OF THE INVENTION

1. Field of the Invention

This invention relates to downhole apparatus, and in particular to apparatus including valves, such as circulating, injection or bypass apparatus.

2. Description of the Related Art

In many downhole operations, such as in the drilling of bores to access subterranean hydrocarbon-bearing formations, it is often necessary to "treat" a particular section of the bore, for example to deliver fluids to stabilize a formation. In these situations it is useful to be able to deliver fluids to specific sections of a bore without having to circulate the fluids down through the length of a tubular drill string extending to the end of the bore and then from the end of the string back up through the annulus to the section of bore to be treated. Such fluid delivery is typically achieved by providing one or more injection or circulating "subs" in the string, which subs provide valves allowing direct communication between the string bore and the surrounding annulus.

An injection or circulatory sub will typically comprise a sleeve valve which is axially movable to uncover ports in the sub body, permitting fluid communication between the string bore and the annulus. The sleeve valve may be pressure actuated, that is the sleeve may be opened by differential pressure between the string bore and the annulus, or may include a bore restriction. The pressure differential necessary to open the sleeve is typically determined by the rating of the spring utilized to maintain the sleeve closed and the sleeve area over which the differential pressure acts.

When such a valve is "cracked", that is initially opened, the elevated pressure in the string bore will tend to cause an initial rush of fluid through the valve, and this rush of fluid may result in seals being damaged or washed out, and in erosion of the valve faces. Further, once the valve has been cracked and fluid flows from the string bore into the annulus, the pressure differential will drop, and this may result in the valve closing before opening again when the bore pressure rises once more. The valve may thus shuttle or "chatter" rapidly, as the differential pressure rises and falls with the closing and opening of the valve, leading to accelerated valve wear and the possibility of fatigue failure.

It is among the objectives of embodiments of the present invention to obviate or mitigate these difficulties.

SUMMARY OF THE INVENTION

According to the present invention there is provided downhole apparatus comprising: a tubular body for mounting on a tubular string; a fluid pressure actuated valve member movable relative to the body; a normally closed flow port in one of the body and valve member, with the valve member in a first position relative to the body the port being closed, and with the valve member in a second position the port being open to permit fluid communication between the body interior and exterior, the valve member being biassed towards the first position; and a latch arrangement for releasably retaining the valve member in the first position, the latch being releasable on application of a predetermined cracking pressure to the valve member, to allow the unlatched valve member to move to the second position in response to a valve opening pressure lower than said cracking pressure, and the latch being resettable on return of the valve member to the first position.

The invention is useful as a circulating or injection sub, and the latch arrangement may be selected to release at a predetermined fluid pressure force, typically a pressure differential between the string bore pressure and annulus pressure, well in excess of the pressure differential which would be encountered in normal operations, thus preventing accidental or unintentional opening; in certain well conditions, situations such as a drop in annulus pressure may result in unintentional opening of conventional apparatus. Further, in a preferred embodiment of the invention, as the latch releases, the drop in differential pressure which tends to be experienced on opening of the port will not result in the valve member reclosing the flow port.

Preferably, the latch is adapted to be resettable when the pressure applied to the valve member falls below a predetermined resetting pressure. Most preferably, the resetting pressure is selected to be lower than the valve opening pressure, such that the valve member may return to the first position, that is the valve may be reclosed, without resetting the latch. This allows the valve member to be subsequently moved to the second position, that is the valve may be reopened, in response to the valve opening pressure, rather than the higher cracking pressure. This offers the advantage that, for example, it is possible to open and close the valve on numerous occasions without having to expose a formation to an elevated cracking pressure each time. When convenient, the pressure may be reduced to the resetting pressure to reset the latch arrangement.

Preferably, the valve member is in the form of a sleeve. Most preferably, the sleeve defines a differential piston, that is there is a differential in the area of the sleeve exposed to internal fluid pressure and the area of the sleeve exposed to external fluid pressure such that a pressure differential creates an axial force on the sleeve.

Preferably also, the latch arrangement is biassed toward a latched configuration, and may be releasable as a result of movement of a latch member, which movement is resisted by a predetermined spring force. Most preferably, the latch releases the valve member following a predetermined degree of movement of the latch member to a latch release point, conveniently the latch member being axially movable to the latch release point. In a preferred embodiment the valve member defines a shoulder for engaging a latch key, on reaching the latch release point the key being radially movable out of engagement with the shoulder. Most preferably, the latch member is biassed towards the latched configuration by a spring arrangement comprising a plurality of springs arranged such that the spring compression ratings are cumulative. Conveniently, this is achieved by providing the latch member with a plurality of longitudinally spaced spring stops and the body with corresponding longitudinally spaced spring stops, with a spring located between each pair of stops. This allows a number of lighter springs to be provided to achieve a relatively high total spring rating; achieving a comparable spring rating using a single spring typically requires a spring of greater thickness thus increasing the volume which must be provided to accommodate the spring and possibly resulting in an unacceptable restriction in internal bore diameter.

Preferably also, the apparatus includes means for urging the valve member towards the first position, most preferably a spring arrangement which applies a predetermined return force to the valve member, such that a predetermined pressure differential, that is the valve opening pressure, producing a force above said return force will hold the valve open, the return force being lower than said predetermined cracking force.

Preferably also, the apparatus includes means for resetting the latch, which means may comprise a spring or other means for biasing the latch to a set position. The resetting means preferably applies a predetermined limited resetting force to the valve member such that only a relatively low predetermined pressure differential, that is a pressure differential below a resetting pressure, allows the latch arrangement to reset.

Preferably also, both the valve member and body define flow ports, which ports are alignable to allow fluid communication. Most preferably, seals are provided on one of the body and the valve member above and below the respective flow port, and the other port passes over and exposes one of the seals when the valve member moves to the second position, the seal only being exposed following unlatching or tripping of the latch; following tripping, the valve member will tend to move very quickly, under the influence of the cracking pressure force, such that the seal will only be exposed for a very short time interval.

Preferably also, the flow port seals are separated from the port by rings defining substantially circumferential slots, which slots serve to disrupt any fluid flow over the ring, and also collect any dirt or debris encountered as the valve member and body move relative to one another. The rings thus serve to protect the seals.

Preferably also, at least one of the ports defines an axially extended opening for communicating with the other port; this arrangement permits a degree of offset between the sleeve and body to accommodate, for example, a build-up of material between the body and valve member restricting movement of the valve member to the desired second position. In the preferred embodiment, the port in the body has an extended inlet opening.

Preferably also, at least one of the ports includes a flow restricting member to control the fluid flow rate through the port.

Where parts of the body and valve member slide or telescope over one another, one surface, typically a male surface, may have a relatively smooth or honed surface and the leading end of the other or female part may define a sharp edge; such an arrangement minimizes jamming or seizing of parts resulting from build-up of scale and the like on exposed surfaces.

BRIEF DESCRIPTION OF THE DRAWINGS

These and other aspects of the invention will now be described, by way of example, with reference to the accompanying drawings, in which.

DETAILED DESCRIPTION OF THE PREFERRED EMBODIMENT

Figure 1:
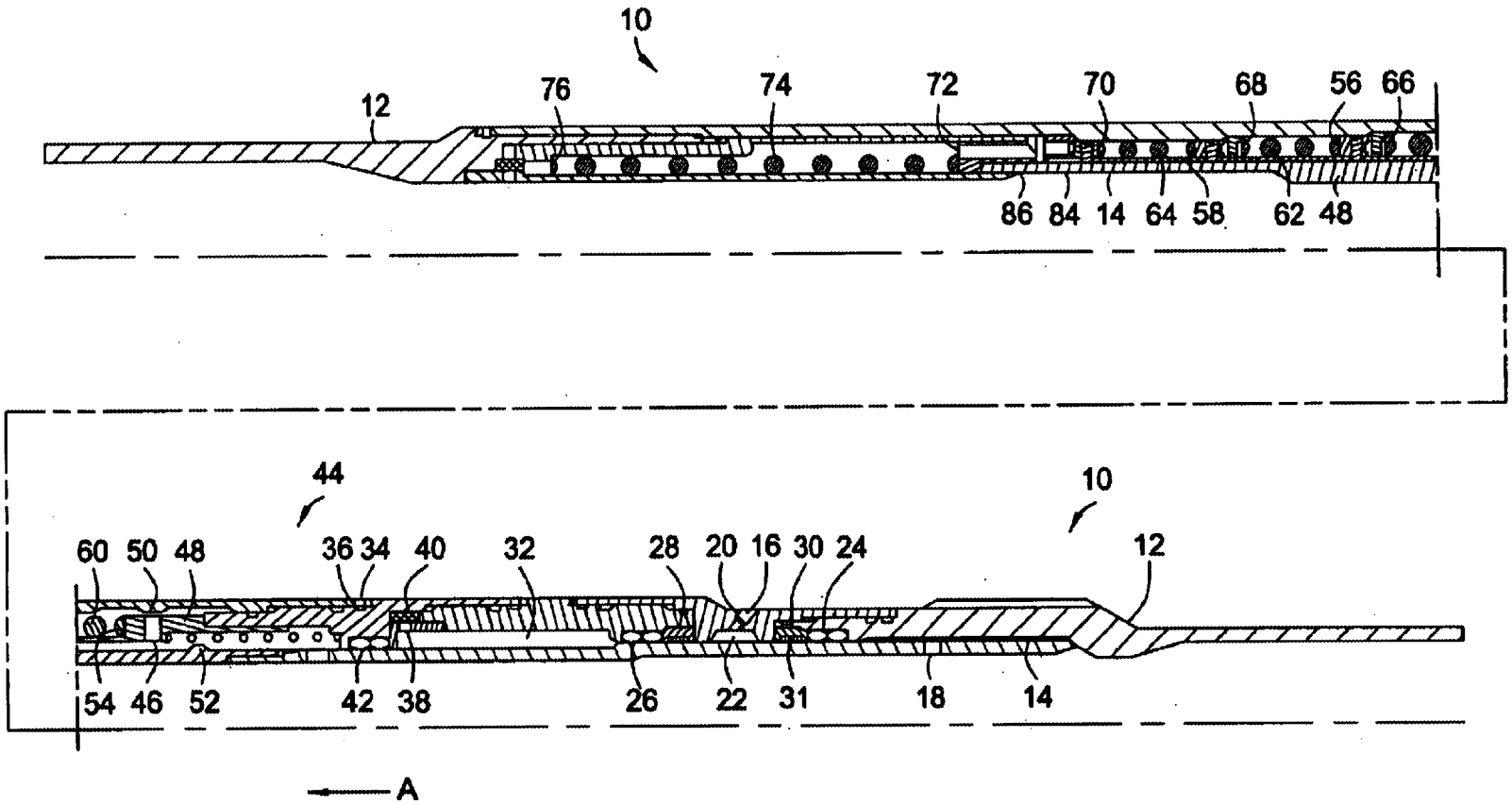
FIG. 1 is a cross-sectional view of a downhole circulating apparatus in accordance with the present invention.
Figure 2:
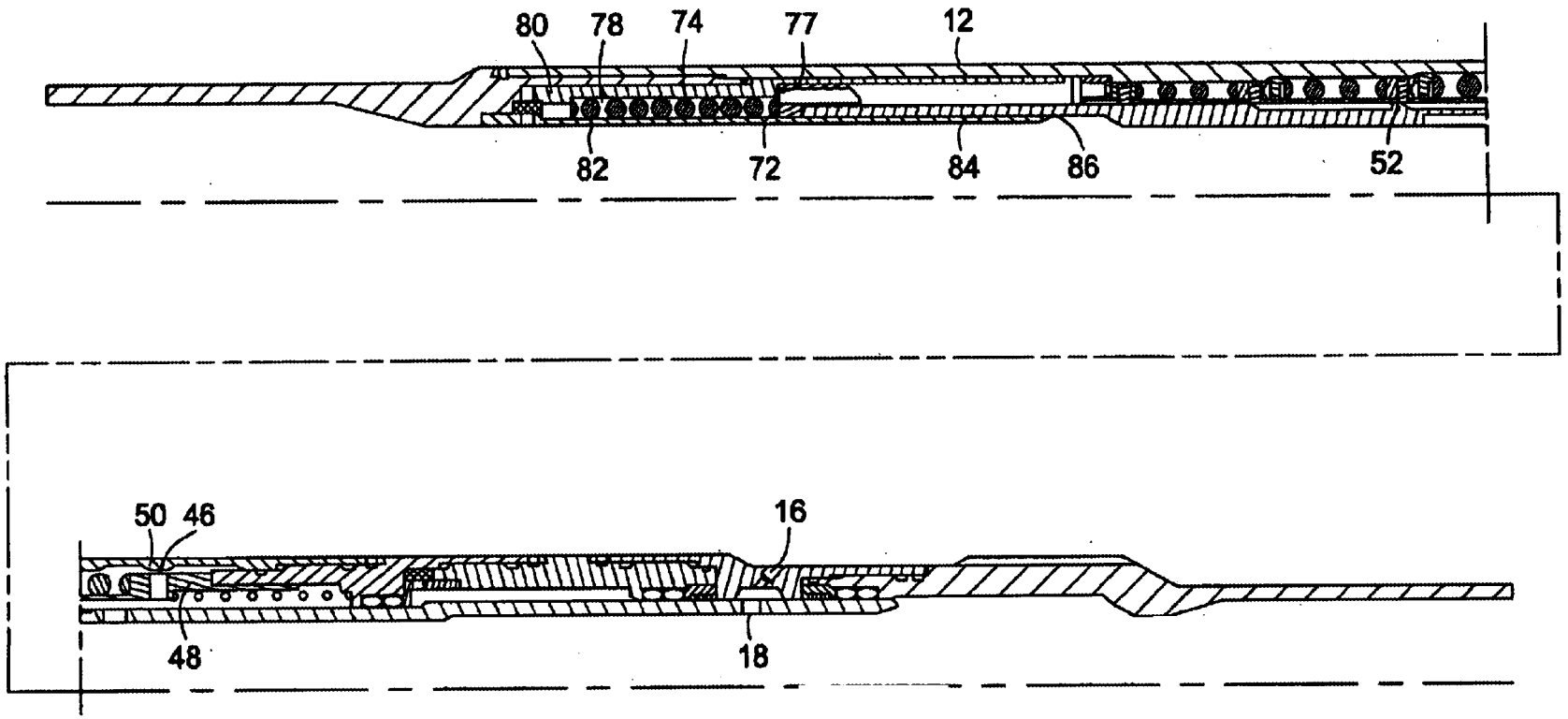
FIG. 2 is a cross-sectional view of a downhole circulating apparatus in accordance with the present invention.
Figure 3:
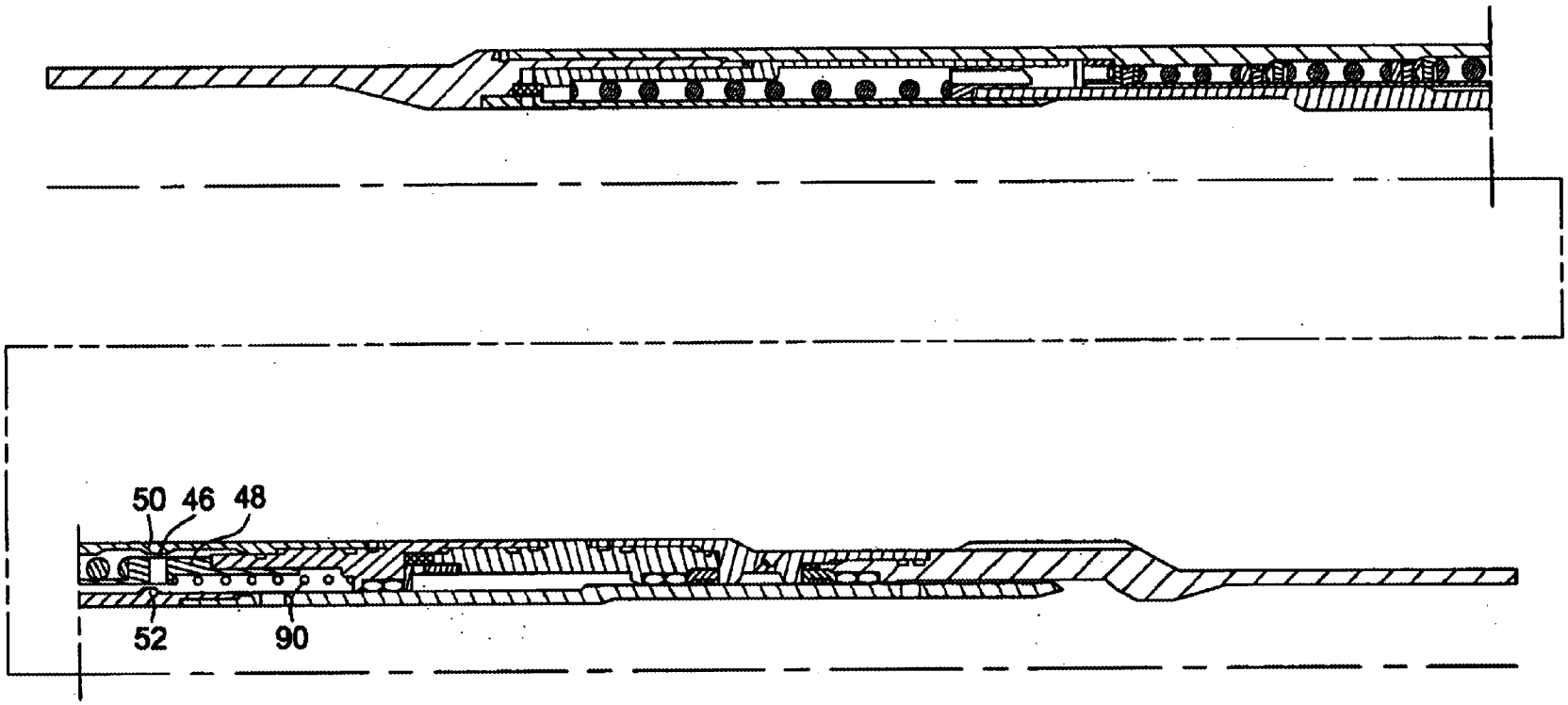
FIG. 3 is a cross-sectional view of a downhole circulating apparatus in accordance with the present invention.

FIGS. 1, 2, and 3 are half sectional views (on two sheets) of a downhole circulating apparatus in accordance with a preferred embodiment of the present invention.

The illustrated circulating apparatus 10 is intended to be incorporated in a tubular string to be located in a drilled bore, and the apparatus 10 comprises a body 12 formed of a number of parts which are threaded and pinned together, the body 12 accommodating a valve member in the form of a sleeve 14, similarly formed of a number of threaded and pinned parts. As will be described, the body 12 and sleeve 14 define flow ports 16, 18 which are initially misaligned (FIG. 1). In use, by application of a predetermined pressure differential between the internal string bore and the annulus around the string exterior, the sleeve 14 may be released from the body 12 and then moved axially to align the ports 16, 18 and permit passage of fluid from the string into the annulus (FIG. 2).

The body port 16 includes a restriction 20 to control the flow rate of fluid through the port 16, and has an axially extended inlet opening 22 adjacent the sleeve 14, providing a degree of latitude in the alignment of the ports 16, 18. Located on either side of the port 16 are seals 24, 26, the seals being spaced from the port 16 by respective diffuser rings 28, 30. Circumferential slots 31 in the rings 28, 30 serve to disrupt any flow of fluid between the rings and the sleeve surface, and also collect any dirt and debris between the body 12 and sleeve 14 when the sleeve 14 moves relative to the body 12, before this reaches the seals 24, 26. The diffuser rings 28, 30 are formed of a low friction material, in this case beryllium copper, and are closely toleranced to minimize leakage past the rings 28, 30.

One of the port seals 26 isolates one end of a chamber 32 defined between the body 12 and sleeve 14, the chamber 32 being in fluid communication with the exterior of the body 12 via a passage 34 defined by port 36, 38 in parts of the body, a filter 40 being provided between the ports 36, 38 to prevent dirt and debris flowing into the chamber 32. The opposite end of the chamber from the seal 26 is provided with a body-mounted seal 42 of slightly smaller diameter than the seal 26, such that, in this example, there is a 6.45 square centimeter (one square inch) differential in the area between the seals 26, 42. Accordingly, an elevated internal pressure produces an axial force on the sleeve 14, tending to move the sleeve 14 (in direction "A") to align the flow ports 16, 18.

Such movement of the sleeve 14 relative to the body 12 is initially resisted and restrained by a latch arrangement 44 comprising a latch key 46 located in an aperture in a spring-mounting latch sleeve 48, and a body shoulder 50 and a sleeve shoulder 52 defined by the body 12 and the sleeve 14, respectively. Initially, as illustrated in FIG. 1, the latch key 46 sits on the body shoulder 50, such that axial movement of the sleeve 14, tending to move the sleeve 14 towards the position where the ports 16,18 are aligned, will bring the sleeve shoulder 52 into contact with the key 46 and the sleeve 14 will thus be axially restrained by the key 46. The spring mounting latch sleeve 48 defines three spring stops 54, 56, 58 each engaging a respective spring 60, 62, 64. The body 12 is provided with corresponding spring stops 66, 68, 70 of decreasing diameter. By appropriate selection of springs, the trip pressure for the apparatus 10 may be between 750–3500 psi, in this example 3500 psi, and if desired only one or two springs may be provided.

In use, a positive differential pressure between the string interior and surrounding annulus results in application of an axial force to the sleeve 14 in direction "A". As noted above, the sleeve 14 is initially restrained by the contact between the sleeve shoulder 52 and the latch key 46. However, on the pressure differential reaching a sufficient level, the "cracking" pressure, the resulting force applied to the key 46 by the sleeve 14 will cause the springs 60, 62, 64 to compress, allowing the latch sleeve 48 to move to a latch release position and the latch key 46 to move from the body shoulder 50. On moving off the shoulder 50, the key 46 is free to move radially outwardly, away from the sleeve shoulder 52, allowing the sleeve 14 to move axially past the key 46 under the influence of the differential fluid pressure force.

The upper end of the sleeve 14 defines a further spring stop 72 which bears against a sleeve return spring 74, the other end of the spring 74 bearing against a stop 76 provided on the body 12. On tripping the latch key 46, the sleeve 14 moves rapidly to compress the spring 74, as illustrated in FIG. 2; the spring 74 will remain fully compressed while a differential pressure of 500 psi or more is maintained. Initially, the spring 74 provides a compression resistance equivalent to 200 psi differential pressure, and this increases to 500 psi when the spring is fully compressed, further compression being prevented by the engagement of the sleeve spring stop 72 with a shoulder 77 defined by the body.

Accordingly, any drop in pressure from the cracking pressure (3500 psi) resulting from the opening of fluid communication between the string interior and annulus is unlikely to bring the pressure differential down to this relatively low level (200 psi), such that the sleeve 14 will remain in the "open" position.

The spring 74 is contained within a chamber 78 defined by a wall 80 of the body 12 and a shroud 82 mounted to the body 12. The end of the sleeve 14 is a sliding fit within the shroud 82 and passes into the chamber 78 as the spring 74 is compressed. To avoid any problems with parts of the apparatus sticking due to the build-up of scale and the like, the sleeve surface 84 is honed and the shroud leading edge 86 defines a sharp corner; as the surface 84 moves beneath the edge 86 any scale is scraped away by the edge 86.

Once the differential pressure drops below 500 psi, the spring 74 will push the sleeve 14 back towards the closed positioned. Thus, the sleeve shoulder 52 will be moved back towards the latch key 46; after tripping, the action of the springs 60, 62, 64 moves the latch sleeve 48 back to the initial position, where the latch key 46 sits on the body shoulder 50. Accordingly, the returning sleeve shoulder 52 will contact the key 46, and will tend to push the key 46 and sleeve 48 such that the key 46 moves off the body shoulder 50 and is thus free to move radially outwardly, such that the sleeve shoulder 52 may move past the key 46, as illustrated in FIG. 3. To return the spring-mounting sleeve 48 and the latch key 46 to the latched position on the body shoulder 50, a light spring 90 is provided between the body 12 and the sleeve 48. The spring 90 moves the sleeve 48, once disengaged from the sleeve 14, back to the latched position.

The sleeve 14 will remain in the closed position, with the flow ports 16, 18 misaligned, until the apparatus experiences a differential pressure of 3500 psi, and which pressure is selected to be above the differential experienced by the apparatus 10 under normal operating conditions. Thus, the sleeve 14 will only open when a relatively high pressure is applied to the string bore, and is unlikely to be opened unintentionally. However, once unlatched, the differential pressure necessary to maintain the sleeve 14 (<500 psi) is considerably lower, such that the sleeve 14 will not close when, for example, the string bore pressure drops as fluid begins to flow through the ports 16, 18. Accordingly, the sleeve 14 will not shuttle between the open and closed positions during a circulating operation. On completion of the circulation operation the pressure within the string bore is reduced to allow the sleeve 14 to close and relatch.

It should however be noted that, in this apparatus 10, the sleeve 14 will only relatch on the differential pressure falling below a predetermined level, in this case 80 psi. Above this, the return force produced by the spring 74 is insufficient to overcome the differential fluid pressure force acting on the sleeve 14 and then relatching spring 90, and the key 46 will not be pushed from the shoulder 50. Thus, the sleeve 14 will close, but will not relatch. This may be useful where it is desired to open and close the ports 16, 18 on a number of separate occasions, without having to apply the elevated cracking pressure to open the ports on each occasion.

The apparatus 10 may be utilized in various different applications, but is particularly suited to applications in which the apparatus 10 is provided in a completion or production string below an electro-submersible pump (ESP), which pump is utilized to draw fluid from the formation up through the string. The provision of the ESP above the apparatus 10 effectively rules out any mechanical intervention, such that the apparatus is controlled by selective application of fluid pressure. As described above, application of an elevated cracking pressure may be utilized to unlatch the sleeve 14, which will then remain open as long as the pressure differential remains above a predetermined opening pressure. Allowing the pressure to drop below the opening pressure causes the sleeve 14 to close, but the sleeve 14 will only relatch if the pressure drops below a predetermined relatching pressure, facilitating subsequent opening of the sleeve. Indeed, it has been found that the sleeve 14 will only relatch if the ESP is started, thus reducing the bore fluid pressure acting on the sleeve 14; in the absence of such a pressure reduction, the sleeve 14 closes the ports 16, 18 and isolates the bore from the annulus before the bore pressure has had the opportunity to drop below the relatching pressure.

It will be apparent to those of skill in the art that the above described apparatus 10 is merely exemplary of the present invention and that various modifications and improvements may be made thereto, without departing from the scope of the present invention. For example, an apparatus in accordance with the invention could be adapted to be opened in response to a positive pressure differential between the annulus and the string bore, to permit flow of fluid from the annulus into the string.

It will also be apparent to those of skill in the art that the above-described apparatus 10 includes a number of features which may be employed in other downhole tools, including the arrangement of mounting the springs 60, 62, 64 such that the individual spring compression rates are cumulative, the seal and port configurations, and the provision of the honed surface and sharp edge to minimize the effects of scale build up on sliding parts. Also, the latch arrangement may be utilized in apparatus and tools other than valves, and in particular in other fluid pressure actuated tools.

While the foregoing is directed to embodiments of the present invention, other and further embodiments of the invention may be devised without departing from the basic scope thereof, and the scope thereof is determined by the claims that follow.

What is claimed is:

1. Downhole apparatus comprising:

a body for mounting on a tubular string and defining a bore;

a fluid pressure actuated valve member movable relative to the body;

a normally closed flow port in one of the body and the valve member, with the valve member in a first position relative to the body the port being closed, and with the valve member in a second position the port being open to permit fluid communication therethrough between the body bore and the exterior of the body, the valve member being biassed towards the first position; and a fluid pressure actuated latch arrangement for releasably retaining the valve member in the first position, the latch arrangement being releasable on application of a predetermined cracking pressure thereto, to allow the unlatched valve member to move to the second position in response to a valve opening pressure lower than said cracking pressure, and the latch arrangement being resettable to relatch the valve member on return of the valve member to the first position.

2. The apparatus of claim 1, wherein the latch arrangement is adapted to be resettable when the pressure applied to the valve member falls below a predetermined resetting pressure.

3. The apparatus of claim 2, wherein the resetting pressure is selected to be lower than the valve opening pressure, such that the valve member may return to the first position without resetting the latch.

4. The apparatus of claim 1, wherein the latch arrangement is adapted to release at a predetermined fluid pressure force resulting from a pressure differential across the body.

5. The apparatus of claim 1, wherein the valve member is in the form of a sleeve.

6. The apparatus of claim 5, wherein the sleeve defines a differential piston, such that there is a differential in the area of the sleeve exposed to bore fluid pressure and the area of the sleeve exposed to external fluid pressure, and a pressure differential between the bore fluid pressure and the external fluid pressure creates an axial force on the sleeve.

7. The apparatus of claim 1, wherein the latch arrangement is biassed towards a valve member latching position.

8. The apparatus of claim 7, wherein the latch arrangement is adapted to be releasable as a result of movement of a latch member, which movement is resisted by a predetermined spring force.

9. The apparatus of claim 8, wherein the latch arrangement is adapted to release the valve member following a predetermined degree of movement of the latch member to a latch release position.

10. The apparatus of claim 9, wherein the latch member is axially movable to the latch release position.

11. The apparatus of claim 9, wherein the valve member defines a formation for engaging a latch key mounted to the latch member, said engagement normally restraining movement of the valve member, and at the latch release position the key is radially movable out of engagement with the shoulder to permit substantially unrestrained movement of the valve member.

12. The apparatus of any of claim 1, wherein the latch arrangement is biassed towards a valve member latching configuration by a spring arrangement comprising a plurality of springs arranged such that the spring compression ratings are cumulative.

13. The apparatus of claim 12, wherein the latch arrangement comprises a latch member having a plurality of longitudinally spaced spring stops and the body comprises respective corresponding longitudinally spaced spring stops, with a spring located between each pair of stops.

14. The apparatus of claim 1, wherein the apparatus includes return means for urging the valve member towards the first position.

15. The apparatus of claim 14, wherein said return means is a spring arrangement.

16. The apparatus of claim 14, wherein the valve member return means is adapted to apply a predetermined return force to the valve member, such that a fluid pressure producing a force on the valve member above said return force will hold the valve member in the open second position, the return force being selected to be lower than the cracking force.

17. The apparatus of claim 1, including relatching means for biasing the latch arrangement towards a valve member latching configuration.

18. The apparatus of claim 17, wherein the relatching means are adapted to reconfigure the latch arrangement in the valve latching configuration only when the pressure falls below a predetermined resetting pressure lower than said valve opening pressure.

19. The apparatus of claim 1, wherein both the valve member and body define flow ports, which ports are alignable to allow fluid communication therethrough.

20. The apparatus of claim 19, wherein seals are provided on at least one of the body and the valve member above and below the respective flow port, and the other port passes over and exposes one of the seals only as the valve member moves to the second position.

21. The apparatus of claim 19, wherein seals are provided on at least one of the body and the valve member above and below the respective flow port, and the flow port seals are separated from the port by rings defining substantially circumferential slots.

22. The apparatus of any of claim 19, wherein at least one of the ports defines an axially extended opening for communicating with the other port, to permit a degree of offset between the valve member and body in the second position.

23. The apparatus of claim 22, wherein the port in the body has an axially extended inlet opening.

24. The apparatus of claim 1, wherein the flow port includes a flow restricting member to control the fluid flow rate through the port.

25. The apparatus of claim 1, wherein parts of the body and valve member are slidable relative to over one another, and a surface of one part has a smooth surface and a leading end of the other part slidable over said one part defines a sharp edge.

26. Downhole apparatus comprising:

a body for mounting on a tubular string and defining a bore;

a fluid pressure actuated valve member movable relative to the body;

a normally closed flow port in one of the body and the valve member, with the valve member in a first position relative to the body the port being closed, and with the valve member in a second position the port being open to permit fluid communication therethrough between the body bore and the exterior of the body; and a fluid pressure actuated latch arrangement for releasably retaining the valve member in the first position, the latch arrangement being releasable on application of a predetermined cracking pressure thereto, to allow the unlatched valve member to move to the second position in response to a valve opening pressure lower than said cracking pressure, and the latch arrangement being resettable to relatch the valve member on return of the valve member to the first position, the latch arrangement being adapted to be resettable when the pressure applied to the valve member falls below a predetermined resetting pressure.

27. A method of operating a downhole apparatus comprising a body for mounting on a tubular string and defining a bore, and a fluid pressure actuated valve member movable relative to the body, the valve member being biassed towards a first position in which a flow port in one of the body and the valve member is closed, and with the valve member in a second position the port being open to permit fluid communication therethrough between the body bore and the exterior of the body, the method comprising the steps:

releasably retaining the valve member in the first position using a fluid pressure actuated latch;

applying a predetermined cracking pressure to the latch to release the valve member;

moving the valve member to the second position; and applying a valve opening pressure lower than said cracking pressure to retain the valve in said second position.

28. The method of claim 27, further comprising:

returning the valve member to the first position.

29. The method of claim 28, further comprising:

resetting the latch to retain the valve member in the first position.

30. The method of claim 29, further comprising:

applying a predetermined resetting pressure lower than said valve opening pressure and resetting the latch.

31. A method of operating a downhole apparatus comprising a body for mounting on a tubular string and defining a bore, and a fluid pressure actuated valve member movable relative to the body, with the valve member in a first position a flow port in one of the body and the valve member being closed, and with the valve member in a second position the port being open to permit fluid communication therethrough between the body bore and the exterior of the body, the method comprising the steps:

releasably retaining the valve member in the first position using a fluid pressure actuated latch;

applying a predetermined cracking pressure to the latch to release the valve member;

moving the valve member to the second position;

applying a valve opening pressure lower than said cracking pressure to retain the valve in said second position; and applying a pressure below said valve opening pressure to cause the valve member to return to said first position.

32. The method of claim 31, further comprising:

resetting the latch to retain the valve member in the first position.

33. The method of claim 32, further comprising:

applying a predetermined resetting pressure and resetting the latch.

34. Downhole apparatus comprising:

a body;

a fluid pressure actuated member movable relative to the body between a first position and a second position and being biassed towards the first position; and a fluid pressure actuated latch arrangement for releasably retaining the member in the first position, the latch arrangement adapted to be tripped on application of a predetermined release pressure to the member, allowing the unlatched member to move to the second position in response to a member displacing pressure lower than said release pressure, and further allowing the unlatched member to return to the first position in response to a member return fluid pressure lower than the member displacing fluid pressure, the latch arrangement being resettable when the pressure applied to the member falls below a predetermined resetting pressure, the resetting pressure being selected to be lower than the member displacing pressure and the member return fluid pressure.

* * * * *